US009624028B2

(12) United States Patent
Neuhaus et al.

(10) Patent No.: US 9,624,028 B2
(45) Date of Patent: Apr. 18, 2017

(54) DISPENSING HEAD AND DISPENSING DEVICE

(71) Applicant: APTAR DORTMUND GMBH, Dortmund (DE)

(72) Inventors: Reinhard Neuhaus, Hemer (DE); Ralf Jordan, Dortmund (DE); Detlef Schmitz, Unna (DE); Swen Barenhoff, Bonen (DE)

(73) Assignee: APTAR DORTMUND GMBH, Dortmund (DE)

( * ) Notice: Subject to any disclaimer, the term of this patent is extended or adjusted under 35 U.S.C. 154(b) by 0 days.

(21) Appl. No.: 14/409,630

(22) PCT Filed: Jul. 8, 2013

(86) PCT No.: PCT/EP2013/002003
§ 371 (c)(1),
(2) Date: Dec. 19, 2014

(87) PCT Pub. No.: WO2014/005723
PCT Pub. Date: Jan. 9, 2014

(65) Prior Publication Data

US 2015/0321828 A1 Nov. 12, 2015

(30) Foreign Application Priority Data

Jul. 6, 2012 (DE) ..... 10 2012 013 352
Aug. 23, 2012 (DE) ..... 10 2012 016 605

(51) Int. Cl.
*B65D 83/20* (2006.01)
*A45D 34/00* (2006.01)
(Continued)

(52) U.S. Cl.
CPC ..... *B65D 83/205* (2013.01); *A45D 34/00* (2013.01); *B05B 11/3097* (2013.01); *B65D 83/206* (2013.01); *B65D 83/345* (2013.01)

(58) Field of Classification Search
CPC .. A45D 34/00; B05B 11/3097; B65D 83/205; B65D 83/206; B65D 83/345
See application file for complete search history.

(56) References Cited

U.S. PATENT DOCUMENTS 3,323,695 A * 6/1967 Monahon ..... B65D 83/206 222/402.13
4,222,501 A * 9/1980 Hammett ..... B05B 11/303 222/207

(Continued)

FOREIGN PATENT DOCUMENTS

DE 2162514 7/1973
GB 1414637 11/1975

(Continued)

OTHER PUBLICATIONS

International Preliminary Report on Patentability for corresponding International Application No. PCT/EP2013/002003, mailed Jan. 6, 2015.

(Continued)

*Primary Examiner* — Kevin P Shaver
*Assistant Examiner* — Bob Zadeh
(74) *Attorney, Agent, or Firm* — Jason H. Vick; Sheridan Ross, PC

(57) ABSTRACT

A dispensing device as well as a dispensing head and use thereof are proposed. Through depression of the dispensing head, an associated dispensing valve is opened and the product to be delivered can escape or be dispensed through an outlet space and via a downstream outlet valve. In order to prevent or at least minimize subsequent dripping or foaming, the volume of the outlet space is initially reduced (Continued)

Figure 1:
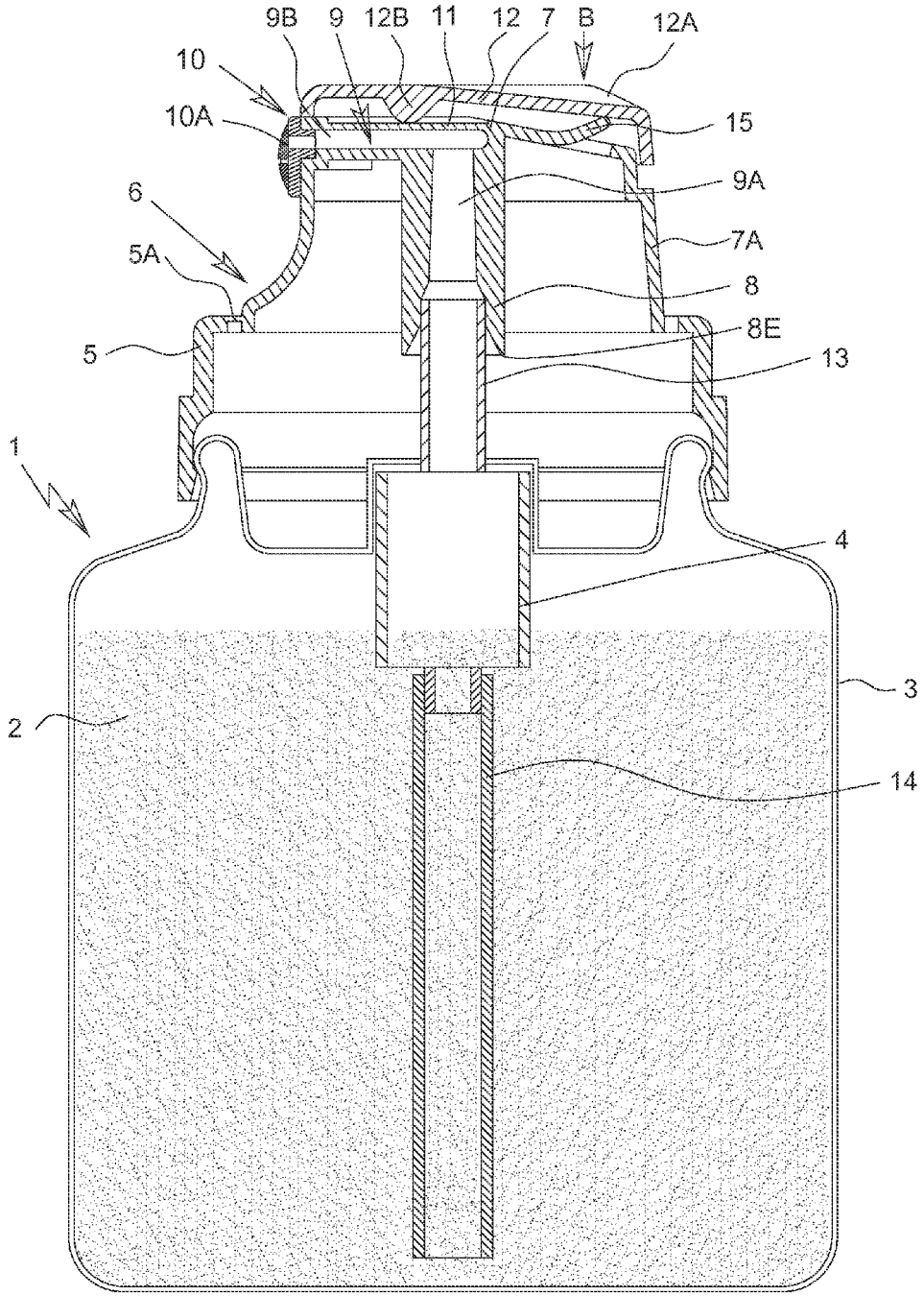

upon actuation of the dispensing head and enlarged again upon completion of actuation, particularly after closing of the dispensing valve, whereby the product is suctioned away from the outlet or outlet valve back into the outlet space.

35 Claims, 12 Drawing Sheets

(51) Int. Cl.
*B05B 11/00* (2006.01)
*B65D 83/34* (2006.01)

(56) References Cited

U.S. PATENT DOCUMENTS 5,732,855 A * 3/1998 van der Heijden .. B65D 83/205 222/402.12
6,264,067 B1 * 7/2001 Lasserre ..... B05B 11/3097 222/108
7,036,691 B2 * 5/2006 Nicolas ..... B65D 83/206 222/153.11
7,891,583 B2 * 2/2011 Sayers ..... B05B 11/3032 222/207
8,240,518 B2 * 8/2012 Canfield ..... A45D 34/04 222/105
8,261,952 B2 9/2012 Canfield et al.
8,360,284 B2 * 1/2013 Carta ..... B05B 11/0016 222/207
8,602,266 B2 12/2013 Canfield et al.
8,616,417 B2 12/2013 Neuhaus
2005/0133542 A1 * 6/2005 Kolanus ..... B65D 83/753 222/402.13
2008/0093380 A1 * 4/2008 Geiberger ..... B65D 83/20 222/108
2010/0147898 A1 * 6/2010 Blumenstein ..... B05B 11/0027 222/402.13
2015/0321828 A1 * 11/2015 Neuhaus ..... B05B 11/3097 222/1

FOREIGN PATENT DOCUMENTS

GB 2463716 3/2010
WO WO 2007/104561 9/2007
WO WO 2008/028619 3/2008
WO WO 2009/125445 10/2009
WO WO 2010/149264 6/2010

OTHER PUBLICATIONS

International Search Report for corresponding International Application No. PCT/EP2013/002003, mailed Jan. 7, 2014.

* cited by examiner

DISPENSING HEAD AND DISPENSING DEVICE

CROSS REFERENCE TO RELATED APPLICATIONS

This application is a national stage application under 35 U.S.C. 371 of PCT Application No. PCT/EP2013/002003 having an international filing date of 8 Jul. 2013 which designated the United States, which PCT application claimed the benefit of German Application No. 10 2012 013 352.9 filed 6 Jul. 2012 and German Application No. 10 2012 016 605.2 filed 23 Aug. 2012, each of which are incorporated herein by reference in their entirety.

The present invention relates to a dispensing head for a preferably cosmetic product according to the preamble of claim 1, a dispensing device with such a dispensing head according to the preamble of claim 14 and a use of a dispensing head according to the preamble of claim 15.

In relation to the present invention, the term "dispensing device" is to be understood particularly as a dispensing head which preferably is or can be mounted on a container or the dispensing valve thereof or on a manually operated pump. In particular, it can also be a pressurized container, a dispenser pump or the like. The dispensing device is preferably used for the non-spraying delivery or dispensing of a preferably cosmetic product. However, it can also be a dosing pump or manually operated pump or any other dispensing device, such as a container, spray head, dispenser or the like, particularly for a cosmetic product.

A dispensing device and a dispensing head particularly for cosmetic products are proposed. Through depression of the dispensing head, an associated dispensing valve is opened and the product to be delivered can escape or be dispensed through an outlet space and via a downstream outlet valve. In order to prevent or at least minimize subsequent dripping or foaming, the volume of the outlet space is initially reduced upon actuation of the dispensing head and enlarged again after completion of actuation, particularly after closing of the dispensing valve, whereby the product is again suctioned away from the outlet or outlet valve into the outlet space.

The term "product" is to be understood as also including liquids, suspensions and fluids, optionally with gas phases. The product can be dispensed as a paste, stream or mist or in another manner, for example as a foam or gel.

Preferably, the dispensing device is used for a cosmetic product. The term "cosmetic product" is to be understood in a narrower sense as cosmetics, hairspray, hair lacquer, deodorant, shaving foam, color spray, sunscreen or skin care agent, and generally agents for beauty care or the like. Preferably, however, other body or hair care products are also included in a broader sense.

For example, the product can be cleaning agents or lubricants or other household products, for example air fresheners, and particularly other technical products as well such as rust removers or the like. Nonetheless, for the sake of simplicity and due to the emphasized use, there is often only mention of cosmetic product in the following.

In today's dispensing heads for the dispensing of, in particular, foaming or foamed products such as shaving foam, or in dispenser pumps, there is often the problem that the product continues to come out, and in particular continues to foam or drip, after completion of the actual dispensing. This problem is particularly blatant in the case of shaving foam or the like but also occurs in non-foamed and non-foaming products and can lead, in particular, to undesired soiling of the dispensing heads.

WO 2007/104561 A2 discloses a dispensing device. According to one variant embodiment, the dispensing device has a dispensing head with an outlet space and a downstream outlet valve for preventing the product from coming out afterwards. Through depression of the dispensing head, it can open an associated dispensing valve of the dispensing device via a connecting section, so that the product can be delivered from the dispensing valve via the outlet space and the outlet valve.

The object of the present invention is to provide an improved dispensing head and an improved dispensing device as well as use, whereby subsequent foaming or dripping of product after completion of an actuation of the dispensing head or of the dispensing device can be prevented or (further) minimized.

The above object is achieved by a dispensing head according to claim 1, a dispensing device according to claim 14 or a use according to claim 15. Advantageous developments are the object of the subclaims.

One aspect of the present invention is that the volume of the outlet space is reduced upon actuation of the dispensing head or dispensing valve and/or enlarged after actuation of the dispensing head or dispensing valve in order to retain the product in the outlet space and/or to suck it (back) into the outlet space or in order to generate a certain vacuum in the outlet space after actuation or after closing of the dispensing valve. In this way, subsequent dripping or foaming of product out of the outlet or outlet space, particularly via the outlet element, can be prevented or at least minimized.

The dispensing head preferably has an outlet element associated with the outlet space on the outlet side. The outlet element is particularly a preferably automatically closing outlet valve. Especially preferably, this outlet valve opens automatically when there is a certain product pressure in the outlet space and/or closes when this or another pressure is undershot, preferably automatically. Alternatively or in addition, the dispensing device or the dispensing head can also have a nozzle or opening as an outlet element. As needed, the outlet valve can also form a nozzle.

For the enlargement and reduction—hereinafter also called variation—of the volume of the outlet space, a particularly elastic deformation of a wall of the outlet space is provided according to one aspect. This enables very simple implementation. For example, the wall is pressed in upon actuation of the dispensing head and reduced here by the volume of the outlet space. Upon completion of the actuation, the wall can particularly assume its original shape again by elastically returning to position, preferably automatically, thus enlarging the outlet space again.

Alternatively or in addition, according to another aspect, a variation of the volume of the outlet space can also be achieved through the relative movement of parts or sections of the outlet space. For this purpose, for example, the connecting section can be coupled, particularly in an axially moveable manner, with the connection space and spring-biased to the dispensing valve and/or into a position which enlarges the outlet space. This also enables simple manufacture and/or reliable function.

The preferred enlargement of the volume of the outlet space after closing of the dispensing valve can have the effect that the outlet valve downstream from the outlet space closes more quickly, since the pressure in the outlet space drops more quickly than if the volume of the outlet space is constant.

Alternatively or in addition, product that is located in the outlet space after the closing of the dispensing valve can still foam, and the resulting volume can be absorbed by the enlarged volume of the outlet space.

Figure 2:
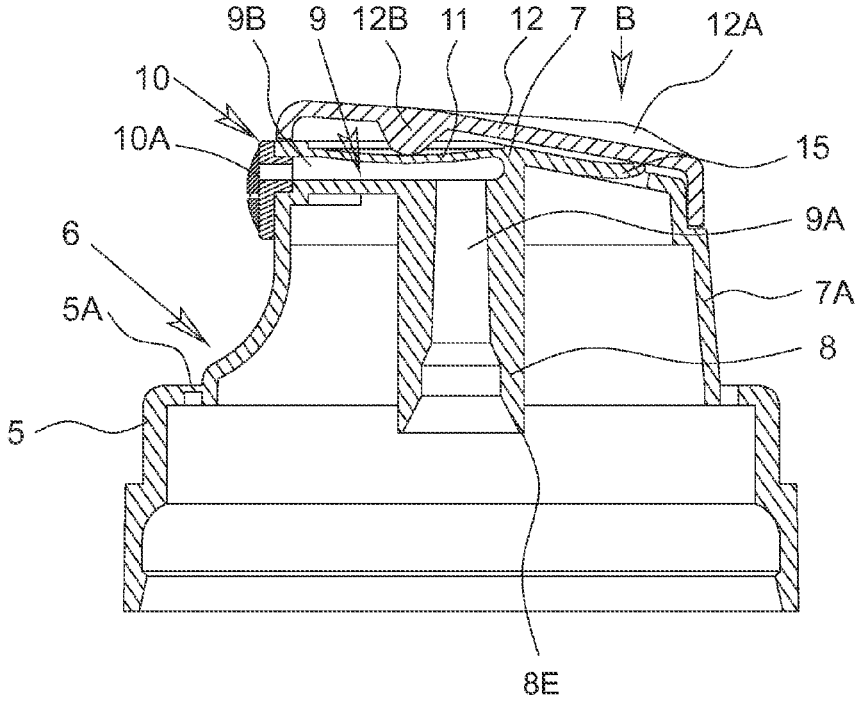
Figure 3:
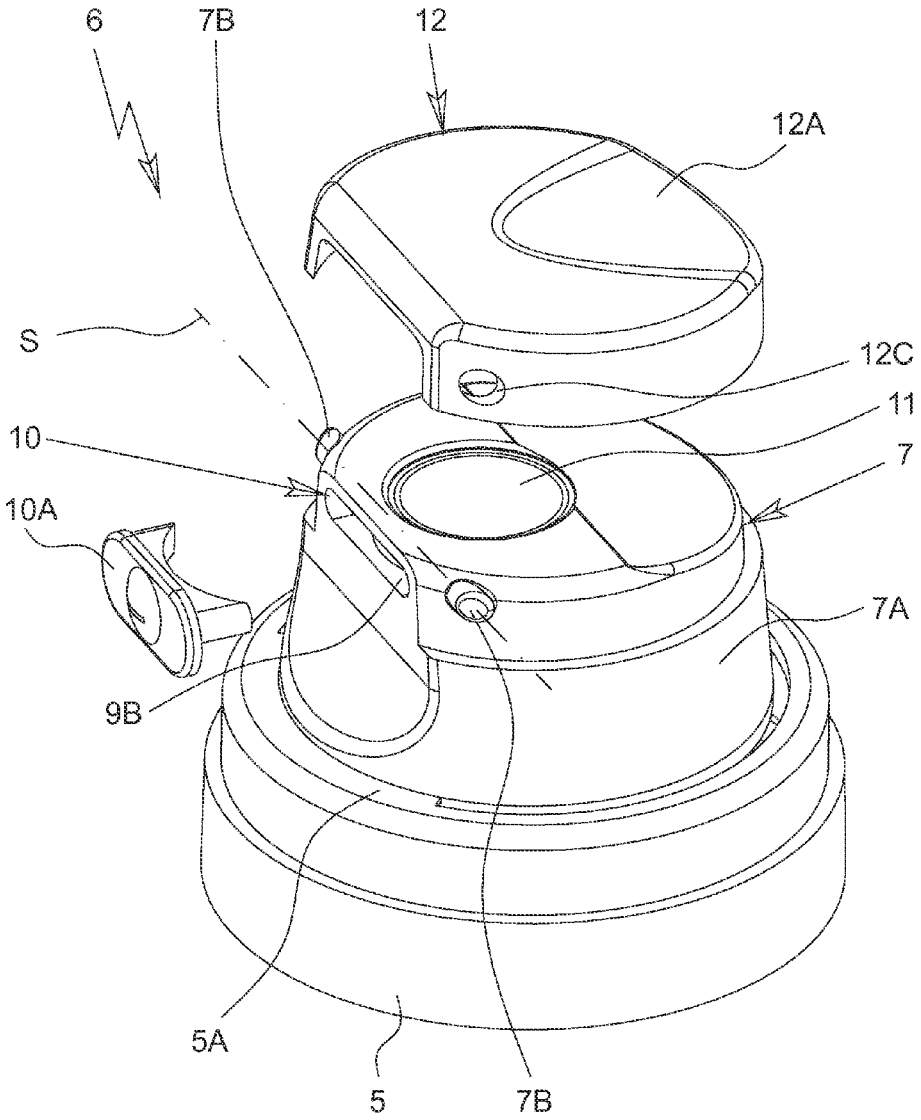
Figure 4:
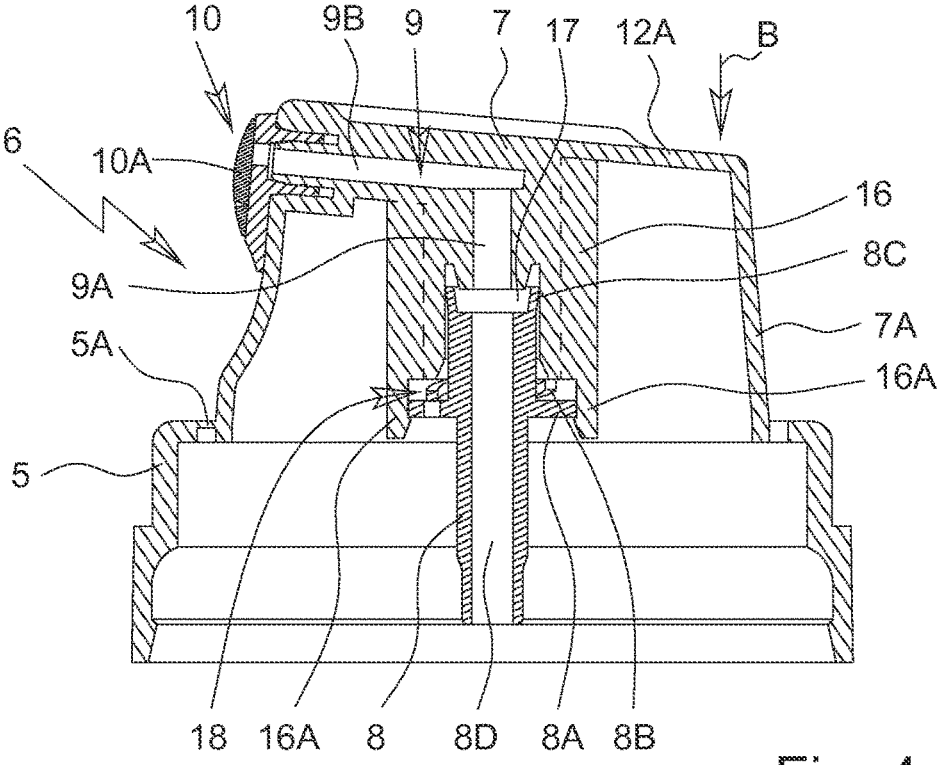
Figure 5:
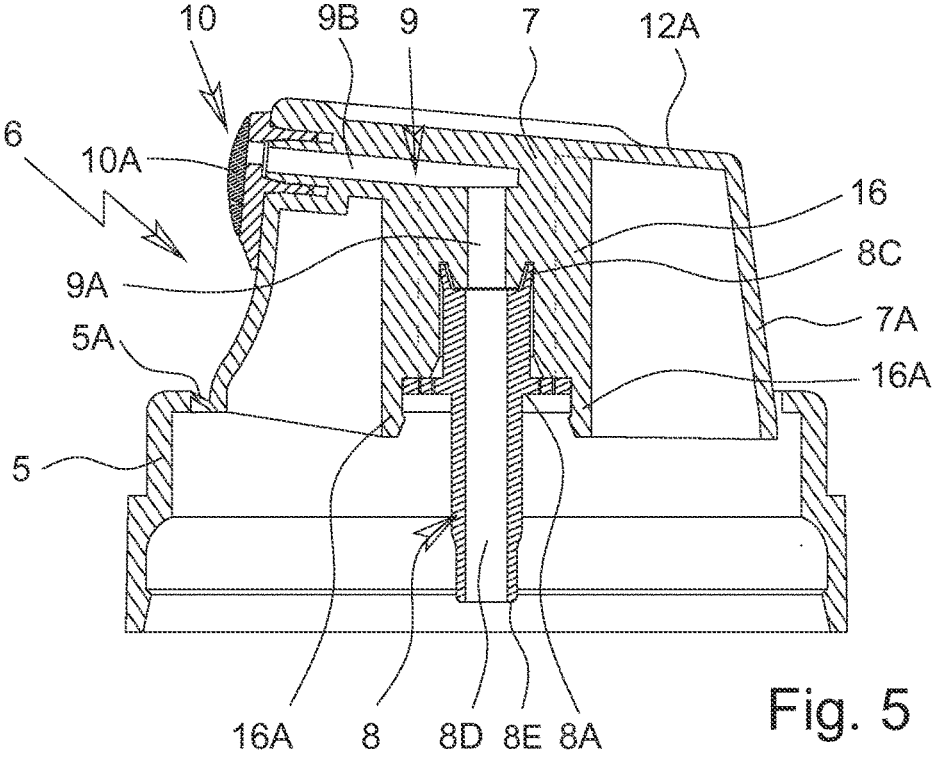
Figure 6:
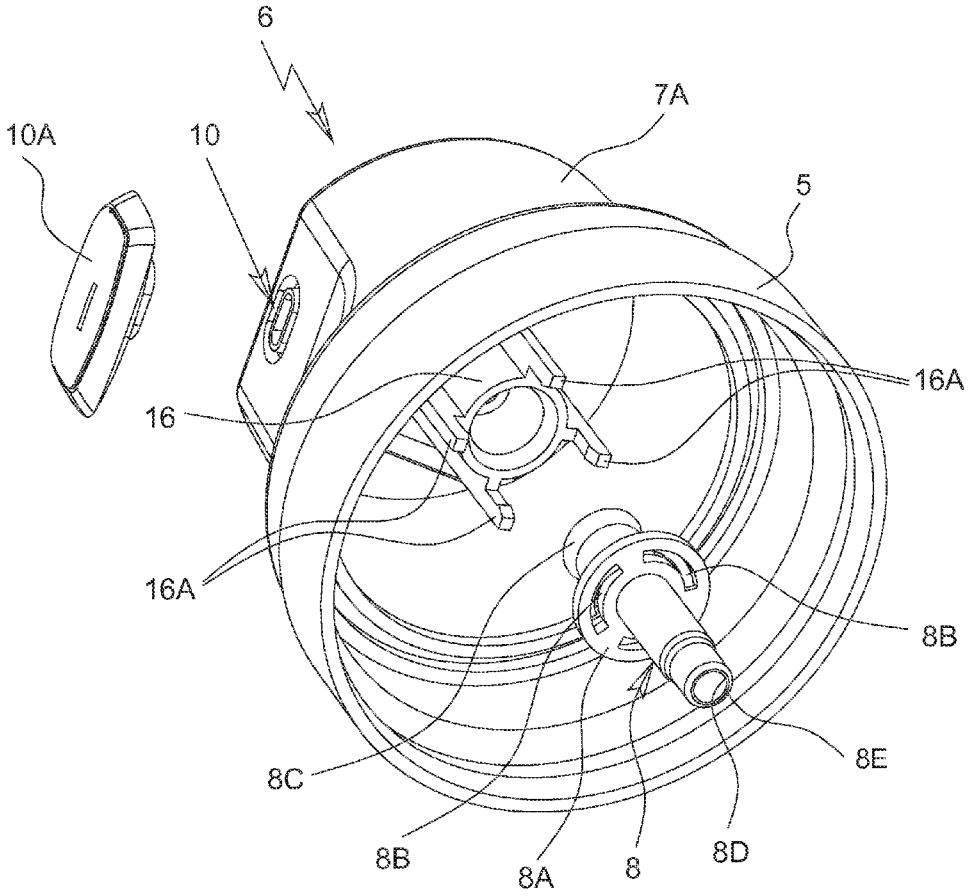
Figure 7:
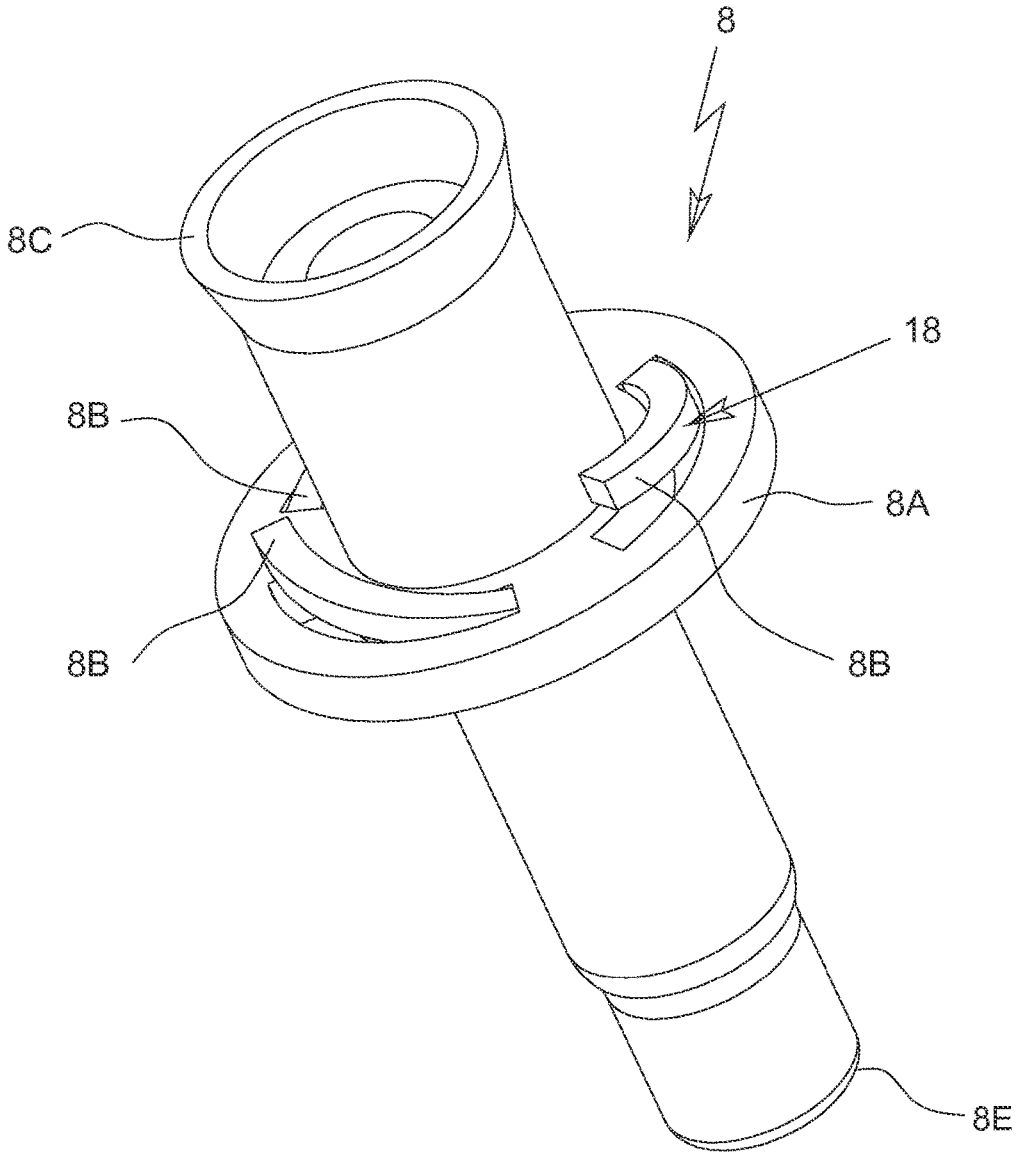
Figure 8:
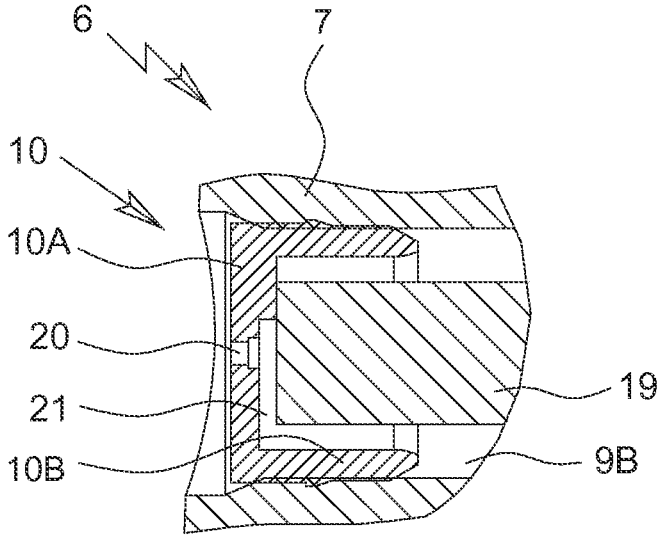
Figure 9:
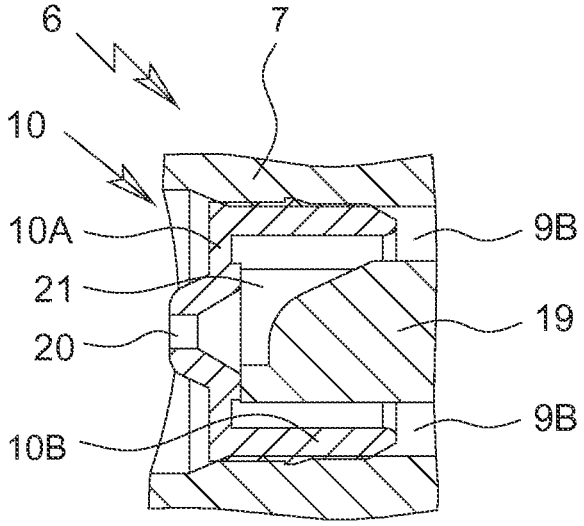
Figure 10:
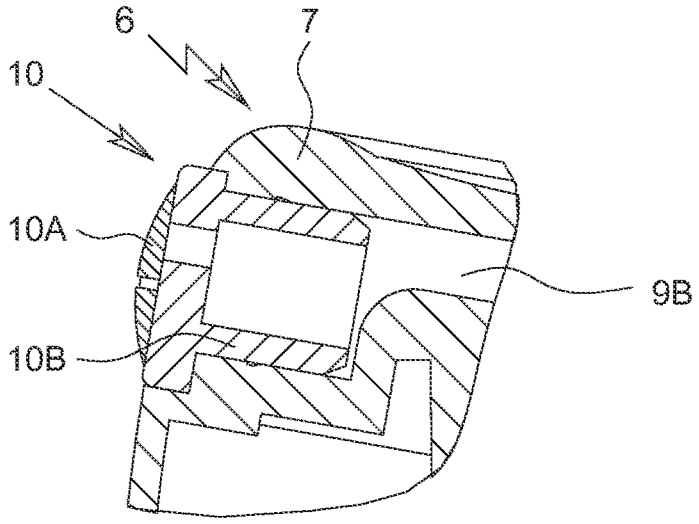
Figure 11:
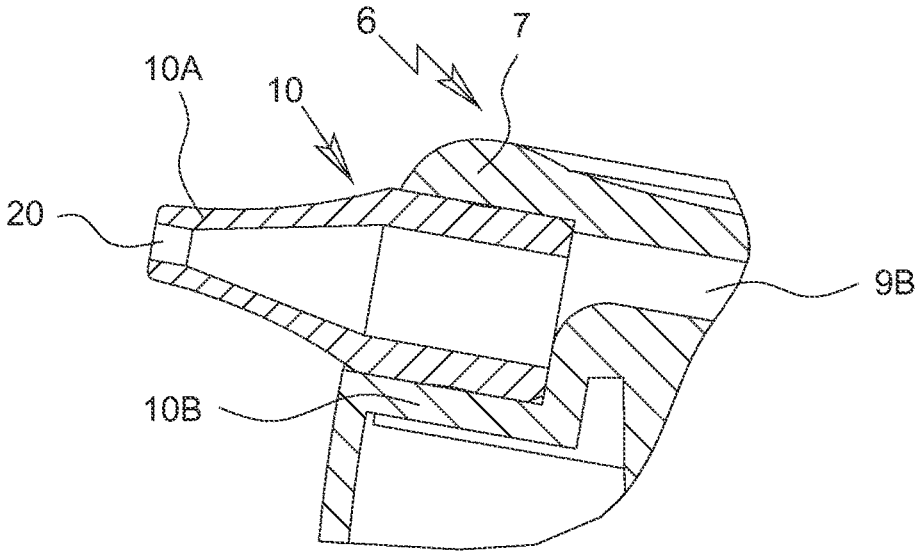
Figure 12:
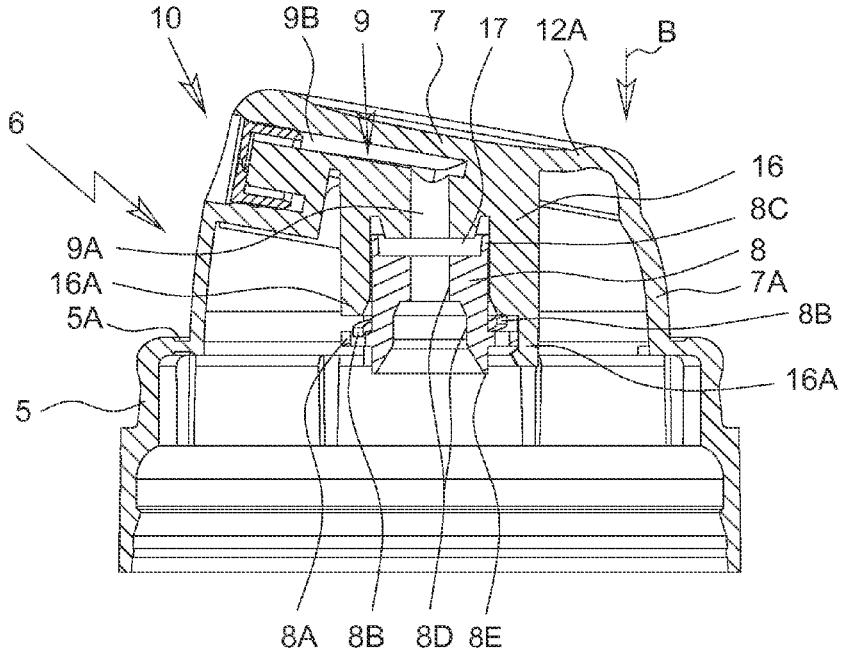
Figure 13:
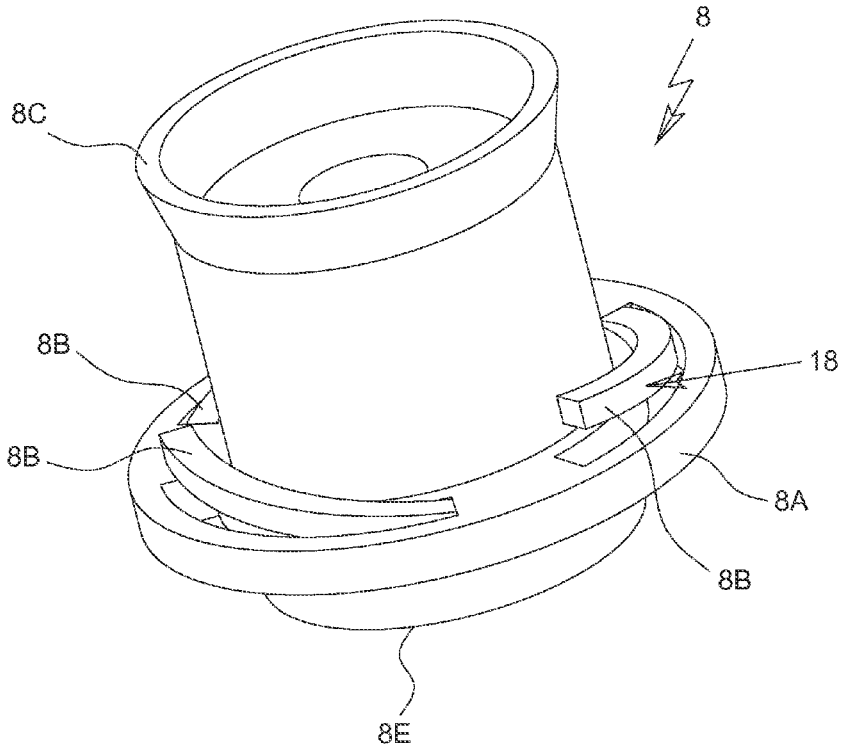
Figure 14:
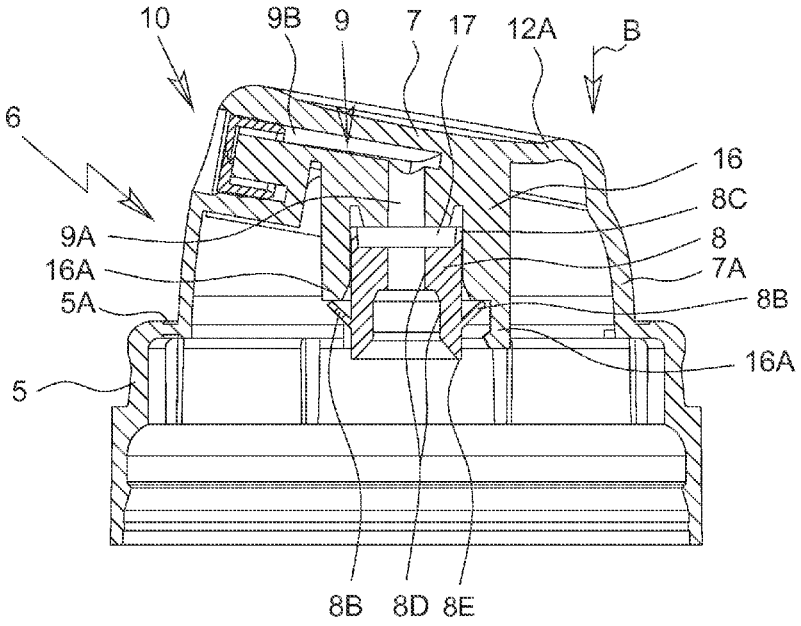
Figure 15:
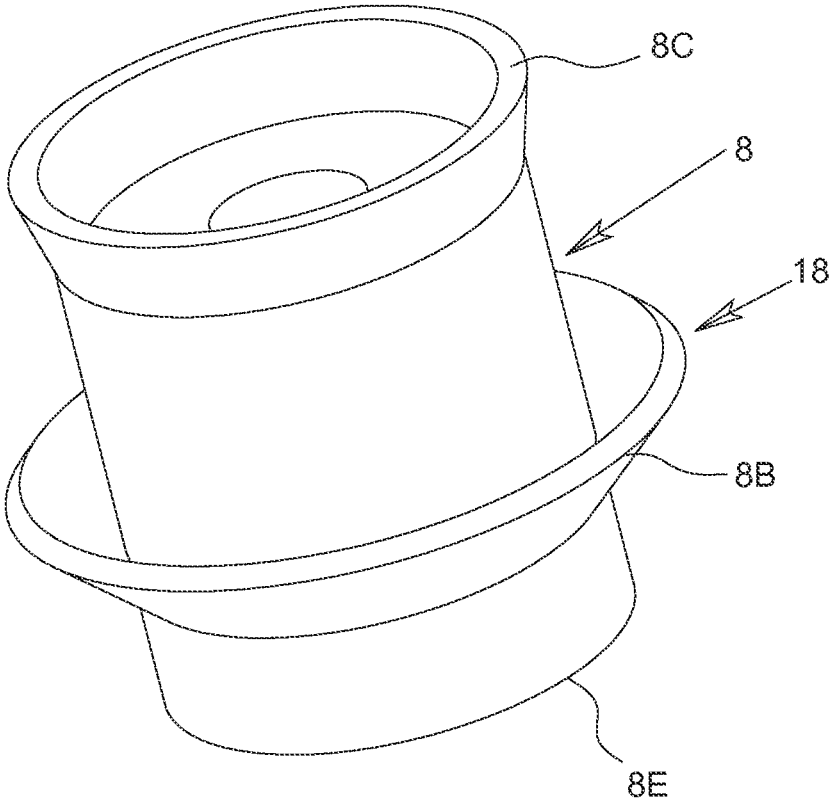

Additional advantages, features, characteristics and aspects of the present invention follow from the claims and the following description of preferred embodiments with reference to the drawing. It shows:

FIG. 1 a schematic section of a proposed dispensing device with a container and with a proposed dispensing head according to a first embodiment in the non-actuated state;

FIG. 2 a schematic section of the dispensing head in the partially actuated state;

FIG. 3 a perspective, exploded view of the dispensing head;

FIG. 4 a schematic section of a proposed dispensing heads according to a second embodiment in the non-actuated state;

FIG. 5 a schematic section of the dispensing head according to the second embodiment in the actuated state;

FIG. 6 a perspective, exploded view of the dispensing head according to the second embodiment;

FIG. 7 a perspective view of a connecting section of the dispensing head according to the second embodiment;

FIG. 8 a schematic, enlarged partial section of a dispensing head in the area of an outlet according to a third embodiment;

FIG. 9 a schematic, enlarged partial section of a dispensing head in the area of an outlet according to a fourth embodiment;

FIG. 10 a schematic, enlarged partial section of a dispensing head in the area of an outlet according to a fifth embodiment;

FIG. 11 a schematic, enlarged partial section of a dispensing head in the area of an outlet according to a sixth embodiment;

FIG. 12 a schematic section of a proposed dispensing head according to a seventh embodiment;

FIG. 13 a perspective view of a connecting section of the dispensing head according to the seventh embodiment;

FIG. 14 a schematic section of a proposed dispensing head according to an eighth embodiment; and FIG. 15 a perspective view of a connecting section of the dispensing head according to the eighth embodiment.

In the figures, which are only schematic and partially not true to scale, the same reference symbols are used for same or similar parts, with commensurate or comparable characteristics and advantages being achieved even if a repeated description is omitted.

FIG. 1 shows a schematic section of a proposed dispensing device 1, which preferably has a proposed dispensing head 6 for the dispensing of a product 2 in the sense mentioned at the outset, for example of a lotion.

The product 2 can be more viscous than water or optionally even be pasty.

In particular, the product 2 can also form a foam or gel.

The product 2 can also contain gas in liquid and/or another form.

In particular, the dispensing device 1 is designed for the non-spraying dispensing of the product 2. Spraying delivery is also possible, however.

Particularly, the product 2 is delivered as a foam, preferably as shaving cream or the like. For this purpose, the liquid 2 is particularly embodied so as to be self-foaming and/or it is foamed during dispensing.

In principle, however, the product 2 can also be dispensed in the non-foamed state and particularly be embodied so as to be non-foaming. Moreover, it is also possible for the product 2 to only foam very little, so that the foaming only enlarges the volume somewhat, for example, but a liquid or pasty consistency is substantially maintained upon dispensing.

It should be noted that, in principle, instead of the dispensing as a foam explained for the sake of example, any other dispensing of the product 2—optionally also as a pasty mass, as a gel, as drops, as a stream or as a spray mist—is possible.

The dispensing device 1 is preferably provided with or connected to a reservoir, particularly a container 3, for the liquid to be delivered 2. The reservoir can thus constitute a part of the dispensing device 1 or can be connected or connectable thereto.

In the depicted example, the reservoir is embodied as a preferably rigid container 3, particularly as a pressurized container. The container 3 is particularly embodied so as to be oblong and/or cylindrical and/or rigid—especially as a metallic can—for the liquid 2.

Preferably, the liquid 2 in the reservoir can be pressurized or is pressurized. In particular, the container 3 or the liquid 2 contains a suitable propellant, preferably a volatile and/or combustible propellant, compressed gas and/or carbon dioxide. However, the dispensing device 1 can also form a pump or the like which suctions the liquid 2 from the container 3 in particular.

The dispensing device 1 or the container 3 preferably has—especially preferably on the front side—a dispensing valve 4 (only indicated schematically) to which the dispensing head 6 is or can be connected. As needed, the dispensing valve 4 can also be a dosing valve or another valve device.

In the depicted example, the dispensing device 1 preferably has a housing part 5 which is or can be connected to the reservoir or container 3, especially preferably can be placed thereupon in a clamping and/or locking manner. Preferably, the housing part 5 is connected to the dispensing head 6 or formed by same.

Especially preferably, the dispensing head 6 or a head section 7 of the dispensing head 6 is depressible or, in the illustration according to FIG. 1, able to be tilted or swiveled downward, especially preferably through a commensurate—in particular, elastically deformable—connection to or support by the housing part 5. However, other structural solutions are also possible.

In the depicted example, the head section 7 preferably extends at least substantially horizontally and/or starting from an outlet 10 or an edge of the housing part 5 or dispensing head 6 toward the middle, particularly via the dispensing valve 4.

The dispensing head 6 or head section 7 preferably has a connecting section 8 which extends toward the dispensing valve 4 and particularly serves to actuate the dispensing valve 4 and/or to fluidly connect the dispensing head 6 to the valve 4. Especially preferably, the connecting section 8 can be moved or depressed accordingly upon actuation or depression or swiveling of the dispensing head 6 or head section 7 in order to actuate or open the associated or connected dispensing valve 4. FIG. 1 shows the non-actuated state.

The dispensing device or the dispensing head 6 has an outlet space 9 and preferably a downstream outlet element 10A.

The outlet space 9 serves to receive product 2 that is dispensed upon actuation of the dispensing valve 4. Furthermore, the outlet space 9 particularly serves to guide the received product to the outlet 10 or the outlet element 10A.

In the depicted example, the outlet space 9 preferably has a delivery channel 9A that is particularly formed in the connecting section 8 and runs, for example, at least substantially vertically in the illustration according to FIG. 1, and/or a connecting channel 9B that runs particularly transverse thereto and/or in the head section 7 or at least substantially horizontally in the illustration according to FIG. 1. In particular, the connecting channel 9B connects the delivery channel 9A to the outlet 10 or to the optional outlet element 10A.

In the depicted example, the housing part 5 and the dispensing head 6 are preferably formed integrally with each other, with the housing part 5 particularly holding the dispensing head 6 in a manner enabling it to be tilted or depressed for example by means of a film hinge or another connecting section which is, in particular, elastically deformable.

The housing part 5 or the dispensing head 6 is preferably injection-molded or manufactured from plastic.

The dispensing head 6 preferably has a valve as an outlet-side outlet element 10A which particularly forms an outlet valve, for which reason it will mostly be referred to as the outlet valve below.

The outlet element 10A or outlet valve preferably closes the outlet 10 or connecting channel 9B on the outlet side. It should be noted that the outlet valve can also seal the delivery channel 9A directly on the outlet side. In that case, the connecting channel 9B can thus be omitted or formed by the delivery channel 9A.

The outlet valve preferably forms an assembly that is particularly installed in a preassembled manner. In the depicted example, the outlet valve is held or received by a recess or receiving notch in the head section 7. Preferably, the outlet valve can be received or held in a locking or clamping manner by the receiving notch. In particular, the outlet valve can be plugged at least partially into the receiving notch. Alternatively or in addition, the outlet valve can also be mounted on the dispensing head 6 or head section 7 or outlet 10 by adhesion, welding or in another suitable manner.

Especially preferably, no nozzle, additional channel or the like is connected to the outlet element 10A or outlet valve or its valve element. Rather, the outlet element 10A or outlet valve opens "to the outside." As a result, after escaping from the outlet element 10A or outlet valve, the product 2 can preferably be removed or used directly by a user (not shown).

It is also possible for the outlet element 10A or outlet valve to form or be integrated into a nozzle. Alternatively, only a nozzle can be provided as an outlet element 10A instead of the outlet valve.

Especially preferably, the outlet valve is embodied as described in WO 2008/028619 A1 or in WO 2010/149264 A1. However, other structural solutions are also possible.

The outlet valve is preferably embodied such that it opens as a function of the prevailing product pressure, particularly upon exceeding a predetermined minimum pressure. When the dispensing valve 4 is opened, the dispensing pressure and hence the prevailing product pressure is greater than the minimum pressure, so that the outlet valve also opens for the desired dispensing of product and generation and delivery of foam.

The dispensing head 6, head section 7 or outlet space 9, particularly the connecting channel 9B here, preferably has a flexible or deformable wall 11. In the depicted example, the wall 11 is relatively thin and/or arranged in a flat side or upper side of the dispensing head 6 or head section 7 or forms these at least in part.

In the depicted example, the dispensing head 6 preferably has an actuation element 12 that can particularly be depressed, deformed or swiveled in order to actuate the dispensing device 1 or dispensing head 6. In the depicted example, the actuation element 12 is preferably held or supported on the dispensing head 6 or its head section 7 in a swiveling manner. However, other structural solutions are also possible.

FIG. 1 shows the dispensing device 1 and the dispensing head 6 in the non-actuated state. In particular, the actuation element 12 is not depressed. Accordingly, the dispensing valve 4 is particularly closed in this state.

In order to actuate the dispensing device 1 in the depicted example, the actuation element 12, particularly in a rear actuation area 12A (the outlet 10 is in the front), is preferably depressed or pressed downward manually by a user (not shown).

As a result of the depression, the actuation element 12 is swiveled and preferably initially against the wall 11 in order to deform it or press it into the outlet space 9 or connecting channel 9B. For this purpose, the actuation element 12 in the depicted example preferably has a projection 12B associated with the wall 11.

The actuation or depression of the dispensing head 6, head section 7 or actuation element 12 is preferably done in a direction of actuation B, as indicated in FIGS. 1 and 2 by an arrow.

In the depicted example, the dispensing head 6 and head section 7 can preferably be tilted about an axis which runs substantially perpendicular to the plane of the drawing of FIGS. 1 and 2, particularly under elastic deformation of a connection area 5A.

FIG. 2 shows an intermediate state or only the dispensing head 6 upon initial or partial actuation. The actuation element 12 is already depressed or swiveled downward. The wall 11 is already deformed or pressed in. As a result, the (initial or normal) volume of the outlet space 9 and connecting channel 9B has been reduced.

The dispensing head 6 or head section 7 or the actuation element 12 can preferably be depressed further.

As a result of the further depression or tilting, the dispensing valve 4 then opens, particularly by a corresponding action of the connecting section 8 on the dispensing valve 4. Especially preferably, the connecting section 8 is connected to the dispensing valve 4 or to a valve element or connection element 13 of the dispensing valve 4, particularly by mechanical and/or fluid insertion. In the depicted example, the connection element 13 is preferably embodied as a connector. In particular, this embodiment and depicted example is a male dispensing valve 4.

When the dispensing valve 4 is opened, the preferably pressurized product in the reservoir or container 3 can particularly flow into the outlet space 9 or delivery channel 9A via a riser tube 14 (see FIG. 1) and the opened dispensing valve 4. Then, for example, at least an initial foaming or the product 2 occurs in the outlet space 9 or delivery channel 9A. Optionally, a foaming device (not shown) can also be provided alternatively or in addition for this purpose. For example, the product 2 or the foam can be guided through a screen (not shown) and/or be foamed (additionally or alternatively) through the introduction of gas or air.

The pressurized product 2 can flow via the delivery channel 9A and connecting channel 9B to the outlet 10 or, if present, the outlet valve or element 10A. The pressure that then acts on the outlet valve brings about an opening of the outlet valve, thus resulting in the desired delivery of the product 2.

After actuation or release of the actuation element 12 or dispensing head 6, a return to the initial position or non-actuated position occurs, preferably as a result of appropriate restorative forces, and optionally also as a result of an additional returning means, such as a spring means 15. The head section 7 with the connecting section 8 thus moves back into the non-depressed initial position, that is, upward again counter to the direction of actuation B. Moreover, the actuation element 12 preferably also returns to its non-depressed position, that is, upward again. Preferably, the dispensing head 6 or head section 7 has a suitable spring means 15, for example a spring-biased crosspiece or the like, which biases the actuation element 12 into its non-depressed initial state and moves back again after it is released. This spring section can be formed or molded on the head section 7 or actuation element 12, for example, as indicated in FIGS. 1 and 2. However, the spring means 15 can also be a separate part such as a spring. Alternatively or in addition, the spring means 15 can be formed or supported by the wall 11, particularly if the wall 11 is embodied such that it automatically resumes its initial position, particularly a non-depressed state, as a result of elastically returning to position. Through this return to position, the actuation element 12 can simultaneously be lifted after release.

The dispensing of product or generation of foam ends particularly when the pressure prevailing in the outlet space 9, or dispensing pressure, falls below the minimum pressure, so that the outlet valve 10 closes again—particularly as a result of an elastic return to position. This is the case if the dispensing valve 4 closes again—particularly as a result of the release or automatic return to position of the dispensing head 6 or head section 7—and the pressure in the outlet space 9 drops again below the minimum pressure. The closed or closing outlet valve then prevents product 2, such as foam or the like, from subsequently coming out or foaming out in an undesirable manner.

In addition or alternatively to the outlet valve, the dispensing device 1 or the dispensing head 6 has, according to the proposal, a (or an additional) measure or device for preventing or at least minimizing the subsequent escape of product 2 from the outlet 10 or outlet element 10A. According to this measure, the volume of the outlet space 9 is enlarged (again) after completion of the actuation of the dispensing head 6 or after the closing of the dispensing valve 4 in order to retain product located in the outlet space 9 in the outlet space 9 or to suction it into same. Through the proposed enlargement of volume, a vacuum can also be formed temporarily in the outlet space 9. Optionally, product 2 can also be suctioned out of the outlet element 10 or a nozzle or the outlet valve back again into the outlet space 9 as a result of the enlargement of volume. As a result, adhesion or contamination of the outlet element 10 or of the outlet A of the dispensing head 6 can be counteracted or prevented.

According to the proposed measure, the volume of the outlet space 9 is enlarged (again) upon ending the actuation or after actuation. In the first embodiment, this occurs as a result of appropriate return to position or moving back of the wall 11 pressed in during actuation to its initial position, that is, particularly into a position that is less pressed in or no longer pressed in.

Especially preferably, the enlargement of the volume of the outlet space 9, that is, the return to position of the wall 11, only occurs after closing of the dispensing valve 4. In order to ensure this, the dispensing head 6 and the dispensing device 1 are preferably embodied such that the restorative force of the head section 7 or connecting section 8 and/or the closing force of the dispensing valve 4 is (substantially) greater than the restorative force of the wall 11 and/or of the spring means 15. Alternatively or in addition, the wall 11 can also be embodied such that it returns to position (substantially) more slowly in comparison to the connecting section 8.

The desired return movement of the connecting section 8 and closing of the dispensing valve 4 before the enlargement of the volume of the outlet space 9 or return to position of the wall 11 is preferably supported or achieved through the closing force of the dispensing valve 4. In particular, the valve element or connection element 13 is specifically biased by spring force into a closed position, upward in the illustration according to FIG. 1.

The wall 11 is preferably embodied so as to be so thin that the desired deformability is achieved. In particular, the wall 11 can have a reduced wall thickness in a desired deformation area, for example a circular area, and/or it can be deepened or recessed on the outside, for example.

To enable good deformability of the wall 11 and/or a change in volume that is as great as possible (difference between enlarged and initial and reduced volume of the outlet space 9), the outlet space 9 or connecting channel 9B is very flat and/or wide in the depicted example in the area of the deformable wall 11, preferably in cross section (transverse to the direction of flow). This is indicated schematically in FIG. 3, which shows the dispensing head 6 in a perspective, exploded view.

FIG. 3 particularly shows the preferred relatively large-surface design of the deformable wall 11, which is characterized by an upper-side recess of the dispensing head 6 or head section 7 in order to reduce the wall thickness and thus increase deformability. The associated outlet space 9 or connecting channel 9B is preferably commensurately wide, as can also be seen from the opening cross section in the area of the outlet A when the outlet element 10 is moved away.

FIG. 3 also shows that the (lower) housing part 5 and the dispensing head 6 or head section 7 are preferably integrally formed and connected to each other here via a preferably relatively thin-walled and/or film hinge-like connection area 5A over a limited circumferential area, particularly below the outlet 10 or outlet element 10A. Preferably, the connection area 5A connects the preferably ring-like housing part 5 to a preferably at least substantially cylindrical casing area 7A of the dispensing head 6 or head section 7. The casing area 7A preferably encloses the centrally arranged connecting section 8. However, other structural solutions are also possible.

As already mentioned, the actuation element 12 is preferably held or supported in a manner allowing it to be swiveled or tilted on the dispensing head 6 or head section 7. The swivel axis S is preferably arranged in the vicinity of the outlet 10 or outlet element 10A, particularly between the outlet A or outlet element 10 on the one hand and the deformable wall 11 on the other hand. In contrast, the actuation area 12A is arranged further from the swivel axis S and on the side opposite the outlet A. This results in a good lever effect which enables the wall 11 to be deformed or pressed in with relatively little force upon depression of the actuation element 12 on the actuation area 12A, particularly via the projection 12B preferably mounted or molded on the actuation element 12.

The actuation element 12 is preferably locked onto the dispensing head 6 or head section 7.

In the depicted example, the dispensing head 6 or head section 7 preferably has two mounting pins 7B which can engage in corresponding mounting recesses 12C of the actuation element 12. Preferably, the actuation element 12 can be locked with its mounting recesses 12C into the mounting pins 7B and thus connected in an articulated manner to the dispensing head 6. However, other structural solutions are also possible.

Below, a second embodiment of the proposed dispensing device 1 and proposed dispensing head 6 is explained in further detail with reference to the other figures. In particular, only substantial differences or new aspects are discussed in detail. The previous embodiments and explanations therefore apply particularly supplementally or analogously. Furthermore, it should be noted that features and aspects of the individual embodiments can also be combined with each other as desired or, alternatively, can be implemented independently of each other.

FIG. 4 shows a schematic section of the dispensing head 6 according to the second embodiment in the non-actuated state. In a similar schematic section, FIG. 5 shows the dispensing head 6 in the actuated state. FIG. 6 shows the dispensing head 6 in a perspective, exploded view from an angle below. FIG. 7 shows a perspective view of the connecting section 8 of the dispensing head 6 according to the second embodiment.

In the second embodiment, the proposed measure for the proposed variation of the volume of the outlet space 9 is preferably achieved by having parts or sections of the outlet space 9 be movable relative to each other. In the depicted example, this is particularly achieved in that the connecting section 8 can particularly be moved axially relative to the head section 7.

Preferably, the dispensing head 6 or head section 7 or outlet space 9 or delivery channel 9A has a receiving section 16 for receiving or movably supporting or holding the connecting section 8. In the second embodiment, for example, this receiving section 16 is relatively similar to the connecting section 8 of the first embodiment, but it is not used to (directly) hold or support the connection element 13 of the dispensing valve 4; rather, in the second embodiment, it is used to receive the connecting section 8. In the second embodiment, the connecting section 8 can therefore also be regarded as a kind of adapter for connecting the associated dispensing valve 4.

Especially preferably, the connecting section 8 is inserted into the receiving section 16.

The connecting section 8 has a through-hole 8D which is used for the fluid connection of the dispensing valve 4 to the dispensing head 6 or outlet space 9 and particularly extends the outlet space 9 and is associated therewith. Preferably, the delivery channel 9A continues in the receiving section 16 or head section 7, particularly axially.

In the non-actuated state, that is, when the dispensing head 6 is not depressed, the connecting section 8 is not completely pushed into the receiving section 16 but moved (somewhat) away from the outlet space 9 and the delivery channel 9A that is adjacent in the head section 7, so that an (enlarged) intermediate volume 17 is formed between them which counts toward the normal or initial or enlarged volume of the outlet space 9, as indicated in FIG. 4.

In order for the connecting section 8 to take up the abovementioned shifted state, the connecting section 8 is preferably spring-biased in the direction of the dispensing valve 4 and away from the head section 7 into a direction which enlarges the outlet space 9. In the depicted example, a corresponding biasing means 18 is provided that can be formed or arranged on the head section 7 and/or connecting section 8, for example.

Preferably, the connecting section 8 has a retention plate 8A and/or at least one or several spring sections 8B which form the biasing means 18 and are preferably arranged on the retention plate 8A, as indicated schematically particularly in FIG. 7.

The spring sections 8B preferably engage on a front side of the receiving section 16 in order to bias the connecting section 8 toward the dispensing valve 4.

The dispensing head 6 or head section 7 or receiving section 16 preferably has hook-like retention arms 16A between which the connecting section 8 or retention plate 8A is held in an axially movable but axially limited manner. The retention arms 16A engage around and/or behind the retention plate 8A. Accordingly, the connecting section 8 is preferably connected non-detachably to the dispensing head 6 or head section 7 or receiving section 16 or held by same.

Upon actuation, the dispensing head 6 is pressed or tilted or swiveled manually downward. A separate actuation element 12 is not required here. Rather, the actuation area 12A is preferably formed here directly on an upper side of the dispensing head 6 or head section 7, especially preferably on the side facing away from the outlet 10.

When the dispensing head 6 is depressed in the direction of actuation B and optionally also tilted somewhat, as indicated in FIG. 5, the connecting section 8 is pushed by the associated dispensing valve 4 (not shown here)—(particularly by its closing force)—against the force of the biasing means 18 into the receiving section 16, whereby the intermediate volume 17 is reduced or closed completely (as a result, the volume of the outlet space 9 is thus correspondingly reduced or made smaller), and the dispensing valve 4 (not shown in FIG. 5) is further actuated by the actuating section 8 and thereby opened.

In the depicted example, the dispensing valve 4 is preferably embodied as a female valve in the second embodiment. The connecting section 8 preferably forms a male adapter that engages or is inserted into the dispensing valve 4. However, other structural solutions are also possible, as will be explained later.

Upon completion of the actuation or release of the dispensing head 6, an automatic return to position preferably occurs, with the dispensing valve 4 particularly closing first and, only thereafter or at least after some delay, the intermediate volume 17 being formed again, that is, the volume of the outlet space 9 being enlarged again and the connecting section 8 returning again to its shifted initial position as shown in FIG. 4. This movement back into the initial position particularly occurs automatically as a result of the biasing means 18. The return movement of the dispensing head 6 or head section 7 particularly occurs as a result of an elastic return to position, particularly due to commensurately elastic characteristics of the connection area 5A and/or as a result of other returning means and/or the closing force of the dispensing valve 4 and the restorative force of the biasing means 18.

The formation or enlargement of the intermediate volume 17 and the axial moving-away of the connecting section 8 from the head section 7 and receiving section 16 upon completion of the actuation leads to the enlargement of the volume of the outlet space 9 provided according to the proposal.

The force of the biasing means 18 is preferably less than the restorative force or closing force of the dispensing valve 4 in order to ensure the desired sequence of the closing of the dispensing valve 4 followed by the moving away of the connecting section 8.

To achieve a fluid seal between the connecting section 8 and the receiving section 16, a seal element 8C is preferably provided which is particularly arranged on the connecting section 8 or especially preferably molded or formed on same. In the depicted embodiment, the seal element 8C is preferably embodied in the manner of a ring or annular lip.

Preferably, the seal element 8C is embodied such that it is self-sealing; that is, under prevailing product pressure, it rests in a preferably automatically sealing manner against an associated sealing surface, which is an inner wall surface of the receiving section 16 in this case. The seal element 8C is therefore preferably correspondingly flexible and/or thin-walled and/or cone-like, particularly with an outer diameter that becomes wider toward the free end.

In the depicted example, the seal element 8C is arranged or molded on the axial end of the connecting section 8 facing away from the dispensing valve 4. In the receiving section 16, an annular groove or the like is preferably formed which is complementary to or fits with the seal element 8C for receiving the seal element 8C when the connecting section 8 is pushed in completely.

However, other structural solutions are also possible in order to achieve the seal.

In general, a provision is made according to the present invention that a back-suction function or a variation of the volume of the outlet space 9 occurs as a proposed measure. Particularly, upon actuation of the dispensing head 6 or before and/or during actuation of the dispensing valve 4 or before, during and/or after the opening of the dispensing valve 4, the volume of the outlet space 9 is reduced and only enlarged again upon or after completion of the actuation of the dispensing head 6 or closing of the dispensing valve 4 arranged or connected upstream from the dispensing head 6 or outlet space 9 in order to retain product 2 in the outlet space 9 and/or to suction it or suction it back into same.

A method and a use as proposed are characterized in that, upon actuation of the dispensing head 6, particularly through depression, the dispensing valve 4 is opened and the volume of the outlet space 9 is reduced. The reduction of the volume of the outlet space 9 can occur before, at the same time as, along with or after the actuation or opening of the dispensing valve 4. Moreover, a method and a use as proposed are characterized in that the dispensing valve 4 is first closed and the volume of the outlet space is only enlarged thereafter. Alternatively, it is also possible for the closing of the dispensing valve 4 to occur more quickly than the enlargement of the volume of the outlet space 9.

The proposed solution or measure can have the effect that the outlet valve can open even under a very low prevailing pressure, since any subsequent foaming or enlargement of volume of the product 2 located in the outlet space 9 that might occur as a result of temperature fluctuations, for example, is preferably more than compensated for by the enlargement of the volume of the outlet space 2.

In particular, the (only) purpose of the outlet valve is to prevent product 2 located in the outlet space 9 from drying out, particularly during an extended period of nonuse.

Alternatively or in addition, the outlet valve can prevent product 2 from inadvertently running or flowing out of the outlet A, for example if the dispensing device 1 tips over.

Especially preferably, the proposed solution or measure of the variation of the volume of the outlet space 9 can also be used together with a nozzle as an outlet element 10A, as also shown below by additional figures, in order to prevent blockage of the nozzle after use as a result of back-suction. This is very advantageous particularly with a spray head for hairspray or the dispensing of hairspray as a product 2 or the like, particularly sticky products, via a nozzle or the like.

FIG. 8 shows an enlarged partial section of a third embodiment of the proposed dispensing head 6. Here, the outlet element 10A is embodied as a nozzle. In the depicted example, the dispensing head 6 preferably has a pin 19 that works together with the outlet element 10A or is covered or engaged by outlet element 10A on the outlet side. In particular, the delivery channel 9A extends in a ring-like manner around the pin 19.

In the depicted embodiment, the outlet element 10A preferably has a particularly central outlet opening 20 and/or at least one feed channel 21. In particular, the feed channel 21 connects the channel 9B to the outlet opening 20.

The outlet element 10A is especially preferably embodied as a vortex nozzle.

In the depicted example, the feed channel 21 preferably extends at least substantially radially.

Preferably, the feed channel 21 is formed on or in the inner side of the outlet element 10A.

As needed, several feed channels 21 can also be provided which run particularly in different radial directions.

In a sectional representation corresponding to FIG. 8, FIG. 9 shows a fourth embodiment of the proposed dispensing head 6. Unlike the third embodiment, the feed channel 21 is alternatively or additionally formed in the pin 19.

In the third and fourth embodiments, the outlet element 10A preferably has a retention section 10B for the insertion and/or locking attachment of the outlet element 10A to the dispensing head 6 or head section 7 and/or outlet 10 or channel 9B. However, other structural solutions are also possible.

In partial sections corresponding to FIGS. 8 and 9, FIGS. 10 and 11 show fifth and sixth embodiments of the proposed dispensing head 6, each with a somewhat modified outlet element 10A.

In the fifth embodiment according to FIG. 10, the outlet element 10A, very similarly to the second embodiment, is embodied as a preferably self-closing outlet valve. Here, however, the outlet valve closes off more harmoniously with the outer side of the dispensing head 6 and is received or inserted at least substantially completely in the dispensing head 6.

In the sixth embodiment according to FIG. 11, the outlet element 10A is preferably embodied in the manner of a spout and/or spray and/or is provided with a relatively large outlet opening 20.

Two additional embodiments of the proposed dispensing heads 6 will be explained in further detail below with reference to FIGS. 10 to 15, with the previous remarks and explanations, particularly with respect to the first and second embodiments, preferably applying analogously or additionally even if they are no longer repeated. In principle, the two additional embodiments of the dispensing head 6 function substantially like the second embodiment; here, however, the dispensing head 6 or terminal section 8 is not designed for connecting to a female dispensing valve 4 but for connecting to a male dispensing valve 4, as in the first embodiment.

In a schematic section corresponding to FIG. 4, FIG. 12 shows the dispensing head 6 according to the seventh embodiment in the non-actuated state. In a perspective view, FIG. 13 shows the connecting section 8 according to the seventh embodiment.

As already mentioned previously, the dispensing head 6 or connecting section 8 is designed for connecting to a male dispensing valve 4. The connecting section 8 is therefore embodied at its connecting end 8E so as to receive a connection element 13 of the dispensing valve 4 which protrudes or projects in a preferably spout-like or sheath-like manner (as shown in FIG. 1). For this purpose, the connecting section 8 or the connecting end 8E is preferably conical and/or provided with an insertion chamfer for the connection element 13 and/or an at least substantially conical and/or cylindrical receiving area for the connection element 13.

In a schematic view corresponding to FIG. 4, FIG. 14 shows the dispensing head 6 according to the eighth embodiment in the non-actuated state. FIG. 15 shows a perspective view of the connecting section 8 according to the eighth embodiment.

The eighth embodiment corresponds in large part to the seventh embodiment, so the remarks and explanations provided in connection with that particularly apply analogously even if they are not repeated.

The eighth embodiment differs from the second and seventh embodiments by a different structural implementation of the biasing means 18. Specifically, this is formed here by a preferably ring-like and/or conical spring section 8B. In particular, a single and/or preferably circumferential spring section 8B is particularly sufficient here instead of the several spring sections 8B provided in the second and seventh embodiments.

The spring section 8B, in turn, is preferably embodied integrally with the connecting section 8.

The spring section 8B preferably points with its free end or circumferential edge toward the receiving section 16 and away from the dispensing valve 4.

FIG. 14 shows the dispensing head 6 in the non-actuated state, just as in FIGS. 4 and 12. In this non-actuated state, the volume of the outlet space 9 or the intermediate volume 17 is enlarged. The spring section 8B is therefore not deformed and ensures that the connecting section 8 is not pushed farther or completely into the dispensing head 6 or head section 7 or receiving section 16.

The spring section 8B is preferably elastically deformable or resiliently flexible, so upon actuation of the dispensing head 6, the connecting section 8 is pushed farther or completely into the receiving section 16 in order to bring about the proposed variation in the intermediate volume 17 and/or in the volume of the outlet space 9.

Preferably, the spring section 8B is circumferential in the eighth embodiment. However, the spring section 8 can also be slotted and/or formed or subdivided by different circumferential sections.

Preferably, the spring section 8B forms a safeguard of the connecting section 8 against unwanted detachment from the dispensing head 6, particularly in conjunction with one or more retention elements 16A engaging radially over the spring section 8D and/or other securing elements.

In the eighth embodiment, the retention plate 8A provided in the other embodiments is preferably omitted.

As already mentioned, individual features and aspects of the different embodiments can also be used in any combination or even implemented independently of each other.

In particular, a dispensing device 1 as well as a dispensing head 6 and the use thereof are proposed. Through depression of the dispensing head 6, an associated dispensing valve 4 is opened and the product 2 to be delivered can escape or be dispensed through an outlet space 9 and via a downstream outlet valve. To prevent or at least minimize subsequent dripping or foaming, the volume of the outlet space 9 is initially reduced upon actuation of the dispensing head 6 and enlarged again upon completion of the actuation, particularly after closing of the dispensing valve 4, whereby the product 2 is suctioned away from the outlet 10 or outlet valve back again into the outlet space 9.

LIST OF REFERENCE SYMBOLS

1 dispensing device
2 product
3 container
4 dispensing valve
5 housing part
5A connection area
6 dispensing head
7 head section
7A casing area
7B mounting pin
8 connecting section
8A retention plate
8B spring section
8C seal element
8D through-hole
8E terminal end
9 outlet space
9A delivery channel
9B connecting channel
10 outlet
10A outlet element
10B retention section
11 wall
12 actuation element
12A actuation area
12B projection
12C mounting recess
13 connection element
14 riser tube
15 spring means
16 receiving section
16A retention element
17 intermediate volume
18 biasing means
19 pin
20 outlet opening
21 feed channel
B direction of actuation
S swivel axis

The invention claimed is:

1. A dispensing head comprising:

a connecting section, an outlet space, an outlet or outlet element downstream from the outlet space and a delivery channel formed within the dispensing head, wherein, upon actuation of the dispensing head, an associated dispensing valve can be opened by the connecting section, so that a product can be delivered from the dispensing valve via the outlet space and the outlet or the outlet element, wherein the dispensing head is constructed such that the volume of the outlet space is reduced during actuation of the dispensing head or before actuation of the dispensing valve and enlarged again upon completion of the actuation of the dispensing head or dispensing valve in order to retain product in the outlet space and/or to suck the product again into the outlet space, wherein the connecting section extends toward the dispensing valve and serves to fluidly connect the dispensing head to the dispensing valve, and wherein the connecting section is held on the dispensing head in an axially moveable manner relative to the delivery channel in order to vary the volume of the outlet space and the connecting section is spring-biased in an axial position.

2. Dispensing head as set forth in claim 1, wherein the outlet element or outlet is open to ambient atmosphere.

3. Dispensing head as set forth in claim 1, wherein the outlet space is formed between the delivery channel and the connecting section.

4. Dispensing head as set forth in claim 1, wherein the dispensing head has a receiving section to directly support or hold the connecting section.

5. Dispensing head as set forth in claim 4, wherein the delivery channel continues in the receiving section.

6. Dispensing head as set forth in claim 1, wherein the dispensing head has an actuation element that can be depressed and/or swiveled to actuate the dispensing head.

7. Dispensing head as set forth in claim 1, wherein the connecting section is spring-biased in an axial position, which enlarges the outlet space, and/or toward the dispensing valve.

8. Dispensing head as set forth in claim 7, wherein the spring force for the biasing of the connecting section is less than the force required to open the dispensing valve.

9. Dispensing head as set forth in claim 7, wherein the dispensing head or connecting section has a circumferential spring section for the spring-biasing of the connecting section.

10. Dispensing head as set forth in claim 9, wherein the spring section is a ring or a cone.

11. Dispensing head of claim 1, wherein one or more of:

the dispensing head is for a cosmetic product, and the outlet is a nozzle or an outlet valve.

12. Dispensing device comprising a container with a dispensing valve and a dispensing head connected thereto, wherein the dispensing head is provided such that the volume of the outlet space is reduced during actuation of the dispensing head or before actuation of the dispensing valve and enlarged again upon completion of the actuation of the dispensing head or dispensing valve in order to retain product in the outlet space and/or to suck the product again into the outlet space, wherein the dispensing head has a connecting section that extends toward the dispensing valve and serves to fluidly connect the dispensing head to the dispensing valve and a delivery channel formed within the dispensing head, and wherein the connecting section is held on the dispensing head in an axially moveable manner relative to the delivery channel in order to vary the volume of the outlet space and the connecting section is spring-biased in an axial position.

13. Dispensing device as set forth in claim 12, wherein the outlet space is arranged or formed between the connecting section and the delivery channel of the dispensing head.

14. Dispensing device as set forth in claim 12, wherein the connecting section is held or arranged on the dispensing head in an axially moveable manner and is spring-biased or moveable in an axial position which enlarges the outlet space and/or toward the dispensing valve.

15. The dispensing device of claim 12, wherein the dispensing device is for a cosmetic product.

16. A method of dispensing a product through a dispensing head, wherein the dispensing head is connected to a container containing the product with a dispensing valve, so that, upon actuation of the dispensing head, the dispensing valve is opened and the product is delivered from the dispensing valve via an outlet space formed in the dispensing head, wherein the volume of the outlet space is reduced through actuation of the dispensing head and is enlarged again upon closing of the dispensing valve in order to retain the product in the outlet space and/or to suck the product into the outlet space, wherein the dispensing head has a connecting section that extends toward the dispensing valve and serves to fluidly connect the dispensing head to the dispensing valve and a delivery channel formed within the dispensing head, wherein the connecting section is moveable relative to the delivery channel in order to vary the volume of the outlet space and the connecting section is spring-biased in an axial position.

17. Dispensing head for a cosmetic product comprising:

a connecting section, with an outlet space and with an outlet or outlet element downstream from the outlet space, wherein the outlet or outlet element is a nozzle or an outlet valve, wherein, upon actuation of the dispensing head, an associated dispensing valve can be opened by means of the connecting section, so that the product can be delivered from the dispensing valve via the outlet space and the outlet or the outlet element, wherein the dispensing head is configured such that the volume of the outlet space is reduced during actuation of the dispensing head or before actuation of the dispensing valve and enlarged again upon completion of the actuation of the dispensing head or dispensing valve in order to retain product in the outlet space and/or to suck the product again into the outlet space, wherein the connecting section is held or arranged on the dispensing head in an axially movable manner, wherein the connecting section is spring-biased in an axial position which enlarges the outlet space, wherein the dispensing head or connecting section has a circumferential spring section for the spring-biasing of the dispensing head or connecting section, wherein the spring section is an arm.

18. Dispensing head as set forth in claim 17, wherein spring section is ring-like and/or conical.

19. Dispensing head as set forth in claim 17, wherein the connecting section is axially movably relative to a delivery channel formed within the dispensing head in order to vary the volume of the outlet space.

20. Dispensing head as set forth in claim 17, wherein the outlet element or outlet opens on the outlet side to the outside.

21. Dispensing head as set forth in claim 17, wherein the connecting section extends toward the dispensing valve and fluidly connects the dispensing head to the dispensing valve.

22. Dispensing head as set forth in claim 17, wherein the dispensing head has an actuation element that can be depressed and/or swiveled in order to actuate the dispensing head.

23. Dispensing head as set forth in claim 17, wherein the spring force for the biasing of the connecting section is less than the force required to open the dispensing valve.

24. Dispensing head as set forth in claim 17, wherein the outlet space is arranged or formed between the connecting section and a delivery channel formed within or by the dispensing head.

25. Dispensing head as set forth in claim 17, wherein the dispensing head has a receiving section to directly support or hold the connecting section.

26. Dispensing head as set forth in claim 25, wherein the delivery channel continues in the receiving section.

27. A dispensing head for a cosmetic product comprising:

a connecting section, an outlet space, an outlet or outlet element downstream from the outlet space and a delivery channel formed within the dispensing head, wherein, upon actuation of the dispensing head, an associated dispensing valve can he opened by means of the connecting section, so that the product can be delivered from the dispensing valve via the outlet space and the outlet or the outlet element, wherein the dispensing head is constructed such that the volume of the outlet space is reduced during actuation of the dispensing head or before actuation of the dispensing valve and enlarged again upon completion of the actuation of the dispensing head or dispensing valve in order to retain product in the outlet space and/or to suck the product again into the outlet space, wherein the connecting section is held or arranged on the dispensing head in an axially movable manner relative to the delivery channel in order to vary the volume of the outlet space, and wherein the connecting section is spring-biased toward the dispensing valve in an axial position which enlarges the outlet space.

28. Dispensing head as set forth in claim 27, wherein the dispensing head or connecting section has a circumferential spring section for the spring-biasing of the connecting section.

29. Dispensing head as set forth in claim 28, wherein the spring section is a ring or cone.

30. Dispensing head as set forth in claim 27, wherein the spring force for the biasing of the connecting section is less than the force required to open the dispensing valve.

31. Dispensing head as set forth in claim 27, wherein the outlet element or outlet opens on the outlet side to the outside.

32. Dispensing head as set forth in claim 27, wherein the connecting section extends toward the dispensing valve and serves to fluidly connect the dispensing head to the valve.

33. Dispensing head as set forth in claim 27, wherein the dispensing head has an actuation element that can be depressed and/or swiveled in order to actuate the dispensing head.

34. Dispensing head as set forth in claim 27, wherein the dispensing head has a receiving section to directly support or hold the connecting section.

35. Dispensing head as set forth in claim 34, wherein the delivery channel continues in the receiving section.

* * * * *